US009695566B2

(12) United States Patent
Braun

(10) Patent No.: US 9,695,566 B2
(45) Date of Patent: Jul. 4, 2017

(54) SOIL COMPACTING DEVICE HAVING SPRING SUSPENSION AND GUIDING

(71) Applicant: Wacker Neuson Produktion GmbH & Co. KG, Munich (DE)

(72) Inventor: Helmut Braun, Bergkirchen (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 98 days.

(21) Appl. No.: 14/805,784

(22) Filed: Jul. 22, 2015

(65) Prior Publication Data

US 2016/0032548 A1 Feb. 4, 2016

(30) Foreign Application Priority Data

Jul. 31, 2014 (DE) ..... 10 2014 011 179

(51) Int. Cl.
*E02D 3/068* (2006.01)
*E02D 3/046* (2006.01)
*E02D 3/074* (2006.01)

(52) U.S. Cl.
CPC ..... *E02D 3/068* (2013.01); *E02D 3/046* (2013.01); *E02D 3/074* (2013.01)

(58) Field of Classification Search
CPC ..... E02D 3/068; E02D 3/046; E02D 3/074
See application file for complete search history.

(56) References Cited

U.S. PATENT DOCUMENTS 3,109,354 A * 11/1963 Van Kirk ..... E02D 3/068 173/122
3,491,662 A * 1/1970 Beierlein ..... E01C 19/38 404/133.1
3,492,924 A * 2/1970 Fors ..... E02D 3/068 404/133.1
3,497,017 A * 2/1970 Henderson ..... E02D 3/068 173/112
3,635,133 A 1/1972 Stougaard
3,802,791 A * 4/1974 Uebel ..... E02D 3/068 404/133.1
3,847,498 A * 11/1974 Grane ..... E02D 3/068 404/133.1

(Continued)

FOREIGN PATENT DOCUMENTS

DE 696 16 058 T2 6/2002
DE 103 55 172 B3 6/2005

(Continued)

*Primary Examiner* — Abigail A Risic
(74) *Attorney, Agent, or Firm* — Boyle Fredrickson, S.C.

(57) ABSTRACT

A soil compacting device has an upper mass, a lower mass coupled to the upper mass so as to be capable of movement and having a soil contact plate, and a holding device for holding the soil compacting device, the holding device being situated so as to be capable of movement relative to the upper mass. In addition, a vibration decoupling device is provided that is situated between the upper mass and the holding device. The vibration decoupling device has a guide device for guiding the movement of the holding device relative to the upper mass. The guide device is fashioned such that the holding device is capable of displacement in parallel relative to the upper mass. The vibration decoupling device also has in addition a spring device.

14 Claims, 3 Drawing Sheets

(56) References Cited

U.S. PATENT DOCUMENTS

| | | | | | |
|---|---|---|---|---|---|
| 4,005,944 | A * | 2/1977 | Harris | E02D 3/068 | 404/133.2 |
| 4,015,909 | A * | 4/1977 | Yamamoto | E02D 3/068 | 173/118 |
| 4,170,427 | A * | 10/1979 | Grane | E02D 3/068 | 404/133.1 |
| 9,284,697 | B2 * | 3/2016 | Steffen | E01C 19/35 | |
| 2013/0004237 | A1 * | 1/2013 | Krings | E01C 19/38 | 404/75 |
| 2013/0279980 | A1 * | 10/2013 | Steffen | E02D 3/046 | 404/75 |
| 2014/0262400 | A1 * | 9/2014 | Berger | E02D 3/046 | 173/148 |

FOREIGN PATENT DOCUMENTS

| | | | |
|---|---|---|---|
| DE | 20 2009 000 264 | U1 | 4/2009 |
| FR | 888976 | A | 12/1943 |
| WO | 03/012205 | A1 | 2/2003 |

* cited by examiner

SOIL COMPACTING DEVICE HAVING SPRING SUSPENSION AND GUIDING

BACKGROUND OF THE INVENTION

1. Field of the Invention

The present invention relates to a soil compacting device such as a tamper.

2. Description of the Related Art

Soil compacting devices are typically used on construction sites, and have a holding device by which the soil compacting device can be held and moved by a user. The holding device is typically mounted with a spring suspension relative to the upper mass, by means of a rubber torsion sleeve. In this way, there results for the holding device, which can be for example a handle, a superposed movement composed of the translational up-and-down movement of the soil compacting device and the rotational movement about the axis of rotation of the rotating spring. This movement corresponds approximately to a rotation about an instantaneous center of rotation that is situated in the vicinity of the center of gravity of the holding device. If the center of gravity is far away from the grip position of a user, this causes a high amplitude of the holding device at the actual user grip position. In this way, the user is exposed to stress due to large hand-arm vibrations.

A low hand-arm vibration in the grip area often causes unsmooth movement of the soil compacting device. The center of gravity is then at a distance from the longitudinal axis of the soil compacting device, so that the accelerating force acting along the longitudinal axis has a lever arm at the center of gravity. In this way, the movement of the soil compacting device during acceleration experiences a rotational portion, so that a pitching movement results.

In addition, it is often the case that components such as accumulators are fastened on the holding device, which on the one hand influences the center of gravity of the holding device, while on the other hand such components are also often exposed to strong vibrations, depending on their position on the holding device.

SUMMARY OF THE INVENTION

The object of the present invention is to indicate a soil compacting device in which there is a low stress on the user due to arm-hand vibrations at, as far as possible, each grip position of the holding device, and in which the compacting movement runs, to the greatest possible extent, without disturbance by other acting forces.

This object is achieved by providing a soil compacting device that has an upper mass and a lower mass having a soil contact plate, the lower mass being coupled movably relative to the upper mass. A holding device for holding the soil compacting device is situated so as to be movable relative to the upper mass, and a vibration decoupling device is situated between the upper mass and the holding device. The vibration decoupling device has a guide device for guiding the movement of the holding device relative to the upper mass, and has a spring device. The guide device is fashioned such that the holding device can be moved parallel relative to the upper mass. Here, being movable in parallel means that during movement relative to the upper mass, the holding device moves along lines that run parallel. This means that extensions of the holding device and the upper mass parallel to one another also run parallel to one another during movement relative to one another.

The soil compacting device can for example be a tamper or a vibrating plate.

Using the holding device, the soil compacting device can be held by a user and guided over the area to be compacted. The holding device can for example be a drawbar, a frame, or a handle. For guiding and holding, a hand grip for the user can be provided on the holding device, on which operating elements for operating the soil compacting device can also be situated.

The soil contact plate can be connected fixedly to the lower mass, and can be capable of tamping or vibrating movement due to the vibrations of the lower mass, in order to compact the area to be compacted.

Through the vibration decoupling device, the vibrations acting on the upper mass can be decoupled from the holding device, so that reduced forces act on the holding device. This also reduces the hand-arm vibrations of a user.

The upper mass typically contains a drive, e.g. an internal combustion engine or an electric motor. The drive connection between the upper mass and the lower mass is typically accomplished via a gear mechanism (not shown such), as a crank drive. The upper mass is typically guided so as to be capable of movement relative to the lower mass. The upper mass and lower mass can be set into vibration relative to one another, the spring device being provided between the upper mass and lower mass. The spring device can have a metallic spiral spring or a leg spring. The spring device can also be an elastomer spring, such as an elastic torsion sleeve, which in addition to the spring property has a damping effect.

The forces acting on the user, which produce the unpleasant hand-arm vibrations, are a function of the ratio of the distance between the grip area of the user and the center of gravity of the holding device on the one hand to the distance between the rotational point of the holding device and the center of gravity of the holding device on the other hand. For hand-arm vibrations that are as low as possible, this ratio must be as small as possible. In the soil compacting device, the holding device is guided so as to be capable of parallel displacement relative to the upper mass by the guide device. Thus, a virtual point of rotation is infinitely far, or very far, from the center of gravity of the holding device. This has the consequence that the magnitude of the hand-arm vibrations to which a user is exposed are independent of the position of the center of gravity of the handle. The center of gravity can thus be chosen arbitrarily without this having any noticeable effect on the magnitude of the hand-arm vibrations.

Because the center of gravity can be chosen arbitrarily without having effects on the magnitude of the hand-arm vibrations, a component such as an accumulator or an electrical component can be attached at any position on the holding device. In this way, it is possible to attach heavy components in the vicinity of the tamping axis on the holding device in order to balance the soil compacting device in an optimal manner, so that no pitching movement arises. Simultaneously, the heavy component is not exposed to larger vibrations, as would be the case if it were attached at a large distance from the tamping axis.

The component can be an electrical energy storage device such as an accumulator, so that a soil compacting device can be used that has an electric motor. Due to the presence of the accumulator, the soil compacting device is independent of external power sources.

In a variant, the holding device can be capable of displacement in the direction of a parallel to a longitudinal axis of the soil compacting device. The longitudinal axis extends in the direction of movement of the lower mass relative to the upper mass. Thus, the longitudinal axis can correspond for example to the working direction of the tamper, or the tamping direction. In this variant, the center of gravity of the holding device is infinitely far from a virtual point of rotation. This can be realized in a simple and low-cost manner by a guide device that has a first guide body that is guided so as to be capable of linear displacement in a corresponding opening of the second guide body. Here, the first guide body can be connected fixedly to the holding device, and the second guide body can be connected fixedly to the upper mass, or vice versa: the first guide body is connected fixedly to the upper mass and the second guide body is connected fixedly to the holding device.

In a further variant, the guide device can have a parallelogram guide structure. The parallelogram guide can have a first guide element connected to the holding device, coupled by a linkage device to a second guide element connected fixedly to the upper mass. The linkage device has two connecting elements situated parallel to one another. In this variant, the holding device is guided parallel to the upper mass, and the center of gravity of the holding device is very far away from a point of rotation. A possible embodiment is a guiding via a four-joint guide or parallelogram guide.

The soil compacting device can have an upper stop device that limits the movement of the holding device away from the upper mass, and a lower stop device that limits the movement of the holding device toward the upper mass. The stop devices can for example be provided by additional springs. It is advantageous to realize the lower stop to be softer than the upper stop.

The holding device can be pushed into the lower stop if a too-strong pressure is exerted when guiding the soil compacting device. The holding device can be pushed into the upper stop if the soil compacting device is lifted by the holding device. This can also take place using a crane, so that the upper stop should be made stable.

A further soil compacting device has an upper mass and a lower mass having a soil contact plate, the lower mass being coupled so as to be capable of movement relative to the upper mass. In addition, a holding device is provided for holding the soil compacting device, the holding device being movable relative to the upper mass and having a front end segment in the direction of a front longitudinal end and a rear end segment in the direction of a rear, oppositely situated longitudinal end. The further soil compacting device has a component that is situated on the holding device closer to the front end segment than to a longitudinal axis of the soil compacting device. A vibration decoupling device is situated between the upper mass and the holding device. The vibration decoupling device has a guide device for guiding the movement of the holding device relative to the upper mass, the guide device being fashioned such that the holding device is capable of rotation relative to the upper mass about an axis of rotation situated in a plane perpendicular to a longitudinal axis of the soil compacting device, the guide device being connected to the holding device at the rear end segment.

In the further soil compacting device, the point of rotation is displaced as far as possible in the direction of the one longitudinal end of the holding device, i.e. in the direction of a front end, and the center of gravity of the holding device is placed as far as possible in the direction of the opposite longitudinal end, i.e. in the direction of a rear end. The displacement of the center of gravity toward the rear takes place via the attachment of the component in the actual grip area of the holding device. In this way, the stress on a user due to hand-arm vibrations is reduced.

The component can be situated in such a way that it is situated either between or under the grip positions of the user on the holding device. The component can also be shaped in such a way that it has openings for the hands of the user. It is also possible to provide grips for the user directly on the component.

The component can be an electrical energy storage device. In this variant, a soil compacting device can be used that has an electric motor. Due to the presence of the accumulator, the soil compacting device is independent of external sources of power.

The vibration decoupling device can have a spring device. The spring device can have only a metal spring, but it can also have a metal spring and an elastomer spring element, such as a rubber torsion sleeve. An elastomer spring element typically has, in addition to the resilient, vibration-decoupling effect, a damping effect, due to a progressive characteristic curve. Due to the center of gravity of the holding device, situated far toward the rear, the rubber torsion sleeves, or the elastomer spring element, are pre-tensioned and thus loaded very strongly, and act very progressively in one direction. The metal spring is then preferably attached and fashioned in such a way that ideally the elastomer spring element is situated at the dead center position in the state of rest of the soil compacting device. This has the consequence that the torsion sleeves, or elastomer spring elements, are loaded less strongly. Instead of the metal spring, a spring element made of a different material can also be used.

It is also possible to protect the elastomer spring elements and to reduce the strongly progressive action by providing a corresponding mechanism, which produces a free travel path about the dead center position, so that more spring travel is available, until the progressive action of the elastomer spring elements acts in the manner of those of the rubber torsion sleeves. This can be realized for example through oblong holes.

The further soil compacting device can also have an upper stop device that limits a movement of the holding device away from the upper mass, and a lower stop device that limits the movement of the holding device toward the upper mass. The stop devices can for example be provided by additional springs. It is advantageous to make the lower stop softer than the upper stop. The holding device can be pressed into the lower stop if a too-strong pressure is exerted during guidance of the soil compacting device. The holding device can be pressed into the upper stop if the soil compacting device is lifted by the holding device. This can also take place by means of a crane, so that the upper stop should be made stable.

These and further features of the present invention are explained in more detail below on the basis of examples, with the assistance of the accompanying Figures.

DETAILED DESCRIPTION OF THE PREFERRED EMBODIMENT

Figure 1:
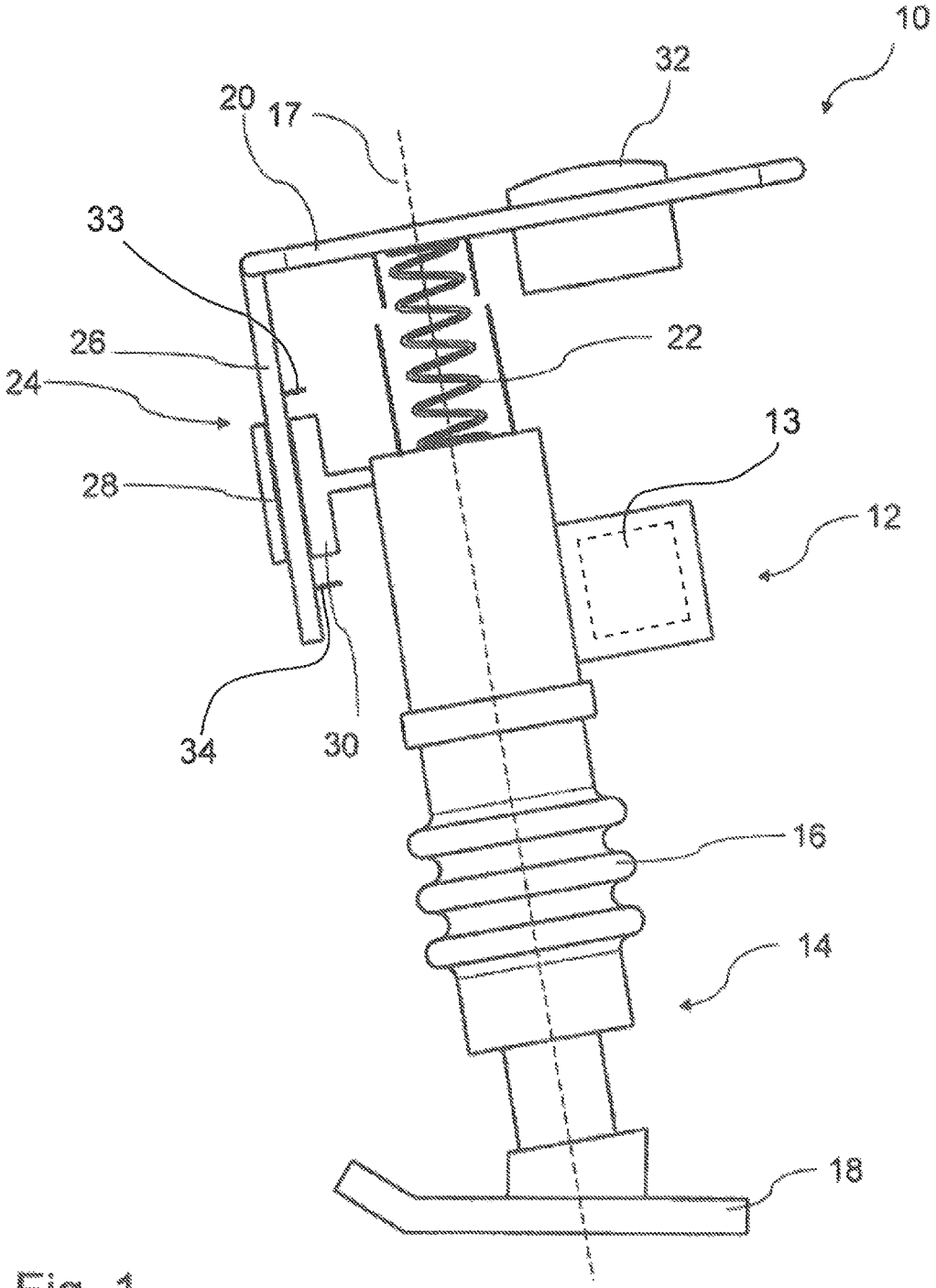
FIG. 1 schematically shows a side view of a soil compacting device having a guide device that permits a parallel displacement of a holding device relative to an upper mass of the soil compacting device.

FIG. 1 schematically shows, in a side view, a soil compacting device 10 having an upper mass 12 and a lower mass 14 that is capable of being moved relative to upper mass 12. Upper mass 12 typically contains a drive 13, and the drive connection between upper mass 12 and lower mass 14 typically takes place via a gear mechanism (not shown), e.g. a crank drive. Upper mass 12 is guided so as to be capable of motion relative to lower mass 14. The gear mechanism and a guide between the upper and lower mass are enclosed by a bellows 16. Lower mass 14 has a soil contact plate 18. Soil compacting device 10 has a longitudinal axis 17 that extends along the direction of movement of lower mass 14 relative to upper mass 12.

Soil compacting device 10 additionally has a holding device 20 for guiding and holding soil compacting device 10, and has a vibration decoupling device 22, 24 situated between upper mass 12 and holding device 20. Holding device 20 is for example a handle. The vibration decoupling device includes a guide device 24, fashioned as a linear guide, for guiding the movement of holding device 20 relative to upper mass 12. Guide device 24 includes a first guide body 26 connected fixedly to holding device 20, such as a guide rail or one or two guide pegs, guided so as to be capable of linear displacement in a correspondingly shaped opening 28 of a second guide body 30 connected fixedly to upper mass 12. Through guide device 24, holding device 20 is capable of being displaced relative to upper mass 12 in the direction of a parallel to longitudinal axis 17 of soil compacting device 10.

Linear guide 24 can be fashioned as a sliding guide, a rolling guide, or a roller bearing mount.

The vibration decoupling device additionally has a spring device 22 that in FIG. 1 is fashioned in the form of a helical spring, for example a wound torsion spring or leg spring. Spring device 22 can however also be fashioned by springs having different spring shapes. Spring device 22 can have a metallic spring and/or an elastomer spring element, such as a rubber torsion sleeve, A rubber torsion sleeve is then for example situated between holding device 20 and guide rail or peg 26 of guide device 24, and connects these to one another. In order to promote low hand-arm vibrations, spring devices 22 having small spring constants are advantageous.

In addition, spring compacting device 10 has a component 32 that is situated on holding device 20. Component 32 can be an electrical energy storage device such as an accumulator or some other electrical component. Component 32 can be situated on holding device 20 in such a way that it is situated between or under the grip positions of a user. Component 32 can also be shaped in such a way that it has openings for the hands of the operator. Alternatively, the grips can be attached on component 32 itself.

Soil compacting device 10 can have stop devices, i.e. an upper stop device 33 that limits the movement of the holding device relative to the upper mass upward, or away from the upper mass, and a lower stop device 34 that limits the movement of the holding device relative to the upper mass downward, or toward the upper mass. The stop devices can, for example, be provided by additional springs. It is advantageous to make the lower stop softer than the upper stop. Holding device 20 can be pressed into the lower stop if a too-strong pressure is exerted when guiding soil compacting device 10, Holding device 20 can be pressed into the upper stop if soil contacting device 10 is lifted by holding device 20. This can for example also take place by means of a crane, so that the upper stop should be made stable.

In the case of an elastomer spring element having a progressive characteristic curve, the stop element can be omitted.

In soil compacting device 10, holding device 20 is guided by guide device 24 so as to be capable of parallel displacement relative to upper mass 12, by means of a linear guide. Thus, a virtual point of rotation is situated infinitely far away from the center of gravity of holding device 20. This has the consequence that the magnitude of the hand-arm vibrations to which a user is exposed is independent of the position of the center of gravity of the handle. The center of gravity can thus be chosen arbitrarily without having any noticeable effects on the magnitude of the hand-arm vibrations. Components on holding device 20 are thus protected from vibrations even if they are situated in the vicinity of the longitudinal axis of soil compacting device 10, such as the tamping axis. Because the center of gravity can be positioned in the vicinity of the longitudinal axis, soil compacting device 10 moves without a pitching movement, and the hand-arm vibrations in the direction of travel are reduced. If a component 32, such as an accumulator, is attached in the vicinity of the longitudinal axis, the stability of soil compacting device 10 does not change due to the removal of the accumulator.

Figure 2:
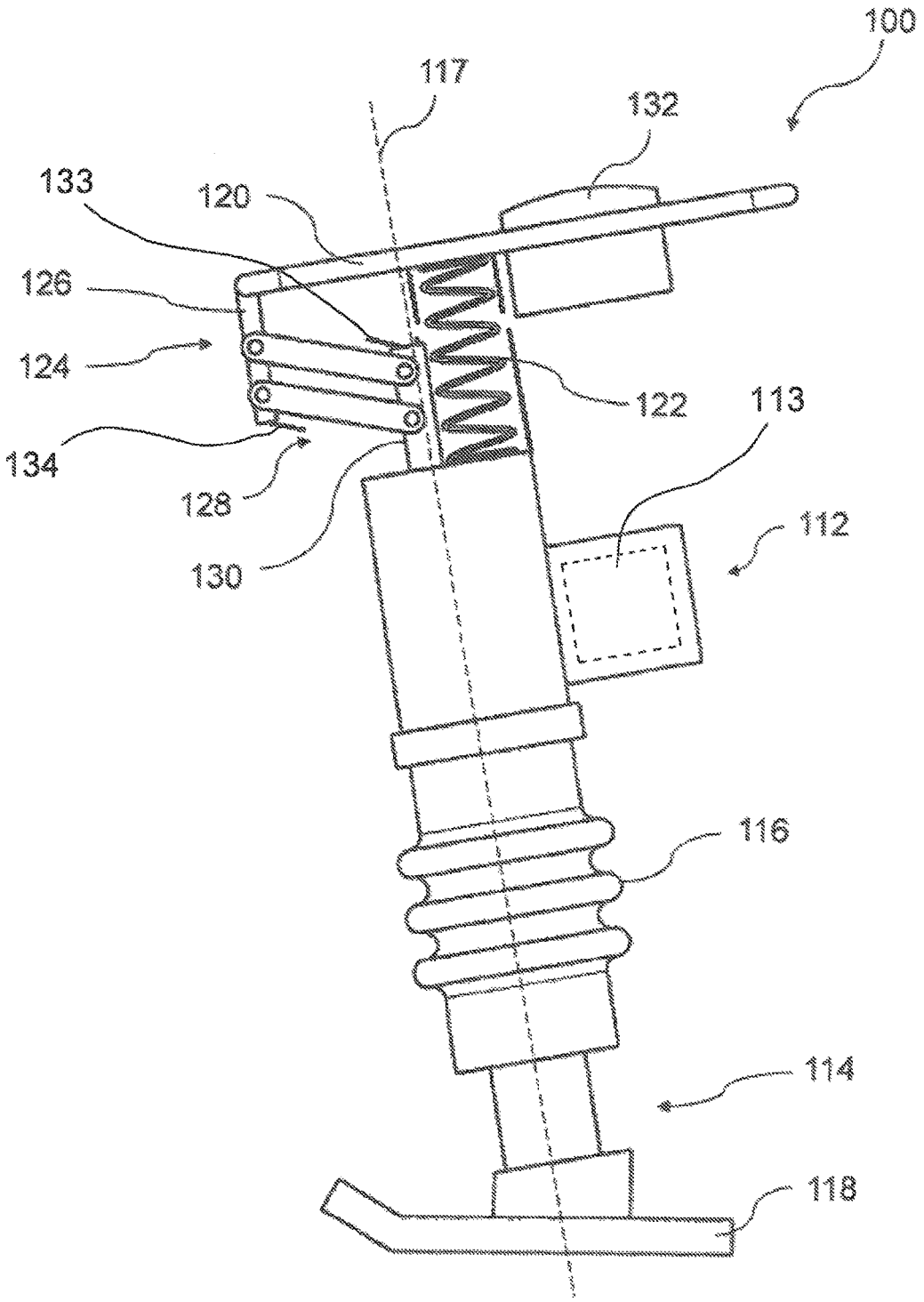
FIG. 2 schematically shows a side view of a soil compacting device having a further guide device that permits a parallel displacement of the holding device relative to the upper mass of the soil compacting device.

FIG. 2 shows a soil compacting device 100 that corresponds to the soil compacting device 10 of FIG. 1 except for the realization of guide device 24.

Soil compacting device 100 also has an upper mass 112, a lower mass 114 having a soil contact plate 118, a bellows 116, a holding device 120 for holding soil compacting device 100, a longitudinal axis 117, and a guide device 124. A component 132 is also attached on holding device 120. A vibration decoupling device 122, 124 is situated between upper mass 112 and holding device 120.

Component 132 can be, as in FIG. 1, an electrical energy storage device such as an accumulator or some other electrical component. Component 132 can be, as in FIG. 1, situated on holding device 120 in such a way that it is situated between or under the grip positions of an operator. Component 132 can also be shaped in such a way that it has openings for the hands of the operator. Alternatively, the grips can be attached on component 132 itself.

In FIG. 2, as in FIG. 1, spring device 122 of vibration decoupling device 122 has the shape of a helical spring, but it can also have any other realization as described in reference to FIG. 1. In addition, as in soil compacting device 10 of FIG. 1, upper and/or lower stop devices 133 and 134, respectively, can be provided.

In the exemplary embodiment of FIG. 2, guide device 124, which is part of the vibration decoupling device, has a parallelogram guide mechanism. Guide device 124 has a first guide element 126 connected fixedly to the holding device, said guide element being coupled by a linkage device 128 to a second guide element 130 that is fixedly connected to upper mass 112. Here, linkage device 128 is fashioned as a four-joint device. First guide element 126 is here formed by a guide rail or, for example, two guide pegs.

In FIG. 2, guide device 124, with linkage device 128, extends forward past upper mass 112, and spring device 122 is situated behind guide device 124.

However, guide device 124 with linkage device 128 can also be situated relative to upper mass 112 in such a way that it does not extend past upper mass 112, or does so only to a slight extent. This can be achieved for example in that first guide element 126 extends, with regard to FIG. 2, above an end region of upper mass 112 in the direction of longitudinal axis 117, and second guide element 130 is situated on upper mass 112 on the oppositely positioned end region of upper mass 112.

Spring device 122 can then be situated between upper mass 112 and holding device 120 in such a way that it is situated within guide device 124 and is enclosed thereby. First guide element 126, second guide element 130, and linkage device 128 describe an inner space in which spring device 122 is situated. In this embodiment, it is possible that the lower end (relative to FIG. 2) of spring device 122 is not connected directly to upper mass 112, but rather is coupled to upper mass 112 via second guide element 130. The lower end in FIG. 2 of spring device 122 can for example be fastened on a web that is part of second guide element 130. The web connects for example two guide plates or pegs, situated parallel to one another, of second guide element 130 to one another. In this embodiment, spring device 122 is situated within guide device 124 at the end region of upper mass 112, at which second guide element 130 is situated.

The interior space of guide device 124 can include an open space that remains open even during the movement of holding device 120 relative to upper mass 112. This open space can be used to accommodate and to guide functional means. The functional means can for example be line connections for guiding electrical signals, electrical energy, or cooling air. A, or the, functional means can be realized as a bellows, an air stream for cooling the motor or component 132 being produced by the movement of holding device 120 relative to upper mass 112.

Second guide element 130 can have two first guide plates (not shown in the Figures) situated parallel to one another, which each interact with a second guide plate situated on holding device 120. The second guide plates extend from holding device 120 in the direction of upper mass 12, and each overlap, in their end region, with the end region of one of the first guide plates. In a specific embodiment, the second guide plates have curved oblong holes, in which a correspondingly shaped guide peg or button of the first guide plates can engage. Through the curved oblong hole, the curved movement of holding device 120 relative to upper mass 112 is taken into account, due to the parallelogram guiding.

The second guide plates can act as stop devices, i.e. as upper stop device 133 in order to limit a movement of holding device 120 relative to upper mass 112 upward, or away from upper mass 112, and as lower stop device 134 in order to limit a movement of holding device 120 relative to upper mass 112 downward, or toward upper mass 112, and in this way to prevent overloading of vibration decoupling device 122, 124. The upper stop device 133 comes into play in particular when soil compacting device 110 is lifted by holding device 120, for example by a crane. In principle, the stop devices also come into play when there is spring compression of holding device 120, if there is excessive loading.

If spring device 122 has a rubber torsion sleeve, this is preferably situated between holding device 120 and first guide element 126, and connects these to one another, so that holding device 120 and first guide element 126 are not fixedly connected to one another, but rather are connected so as to be capable of movement.

In soil compacting device 100, holding device 120 is guided by guide device 124, as shown in FIG. 1, so as to be capable of parallel displacement relative to upper mass 112, by means of a parallelogram guide fashioned as a four-joint device. Here, a virtual point of rotation is situated very far away from the center of gravity of holding device 120. This has the consequence that the magnitude of the hand-arm vibrations to which a user is exposed are independent of the position of the center of gravity of the handle. The center of gravity can thus be selected freely without this having noticeable effects on the magnitude of the hand-arm vibrations. Thus, in soil compacting device 100 of FIG. 2, the same advantages result as in soil compacting device 10 of FIG. 1.

Figure 3:
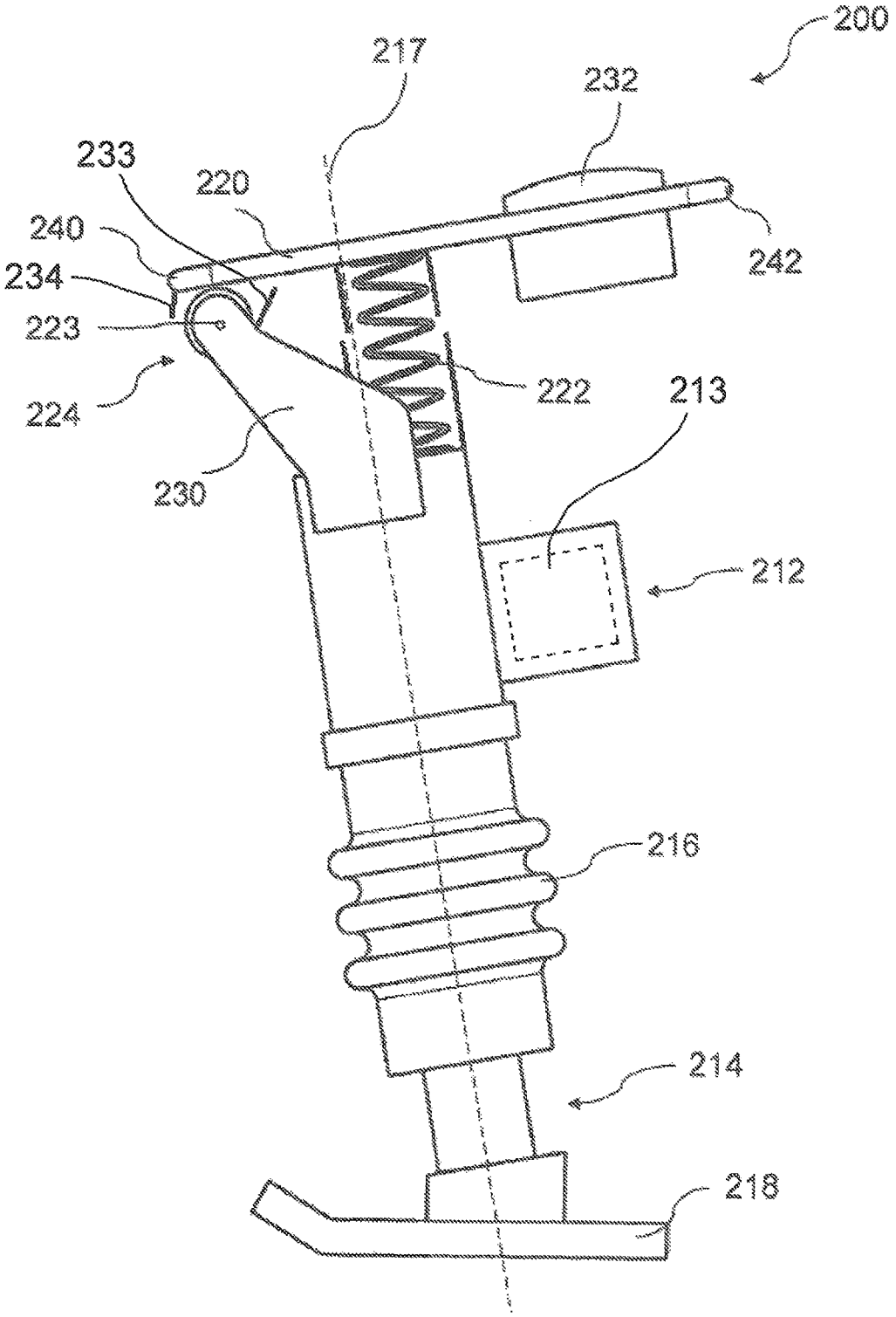
FIG. 3 schematically shows a side view of a soil compacting device according to a further specific embodiment having a guide device that permits a rotational movement of the holding device relative to the upper mass of the soil compacting device.

FIG. 3 shows a further specific embodiment 200 of a soil compacting device that also has an upper mass 212, a lower mass 214 having a soil contact plate 218, a longitudinal axis 217, a holding device 224 holding soil compacting device 200, and a vibration decoupling device 222, 224. As in the soil compacting devices of FIG. 1 and FIG. 2, upper mass 212 typically has a drive 213, and the drive connection between upper mass 212 and lower mass 214 is typically accomplished via a gear mechanism (not shown). Upper mass 212 is guided so as to be capable of movement relative to lower mass 214. The gear mechanism, and a guide between the upper mass and lower mass, are enclosed by a bellows 216.

Holding device 220 is connected to upper mass 212 so as to be capable of movement, here to a frame 230 of the upper mass. A guide device 224 for guiding the movement of holding device 220 relative to upper mass 212 is situated between upper mass 212 and holding device 220, and is fashioned in such a way that holding device 220 is capable of rotation relative to upper mass 212, about an axis of rotation 223 situated in a plane perpendicular to a longitudinal axis of soil compacting device 200. Guide device 224 can have a rotational spring, for example a rubber rotational spring such as a rubber torsion sleeve, as part of a spring device. Guide device 224 is part of a vibration decoupling device.

In addition, a component 232, e.g. an accumulator, is situated on holding device 220. Holding device 220 has a front end segment in the direction of the front longitudinal end 240 and a rear end segment in the direction of a rear longitudinal end 242, situated opposite thereto. In the depicted exemplary embodiment, guide device 224 at the front end segment is connected to the holding device, and component 232 at the rear end segment is situated in holding device 220, so that the point of rotation and component 232 are situated as far as possible from one another. Axis of rotation 223 is situated as far as possible from rear longitudinal end 242 of holding device 220, and is situated as close as possible to front longitudinal end 240.

Component 232 can be an electrical energy storage device such as an accumulator or an electrical component. Component 232 can be situated on the holding device in such a way that it is situated between or under the grip positions of an operator. Component 232 can also be shaped in such a way that it has openings for the hands of the operator. Alternatively, the grips can be attached on component 232 itself.

As in the soil compacting devices of FIGS. 1 and 2, a spring device 222 is situated between upper mass 212 and holding device 220 as part of the vibration decoupling device. In the example of FIG. 3, spring device 222 has a helical spring, for example a metallic helical spring. In order to promote low hand-arm vibrations, spring devices 222 having a small spring constant are advantageous.

As described above, the spring device can in addition have an elastomer spring element, such as a rubber torsion sleeve situated along the axis of rotation 223, situated between holding device 220 and upper mass 212, or web 230. The elastomer spring element is pre-tensioned by the weight of component 232, so that in this direction it acts very progressively and is strongly loaded. Metal spring 222 can then be situated and fashioned in such a way that, in the rest position of holding device 220, the rubber torsion sleeves are in the dead center position, in order to counteract the pre-loading of the rubber torsion sleeves by the inherent weight of component 232 and of holding device 220.

Through a corresponding mechanism, such as oblong holes, a free travel path around the dead center position can also be produced, so that a larger spring travel is available until the progressive action of the elastomer spring element takes effect.

In a further alternative, no rubber torsion element is situated between upper mass 212 and holding device 220; rather, only metal spring 222 is provided as part of the spring device.

In a further variant, soil compacting device 200 can have, in addition to metal spring 222, stop devices, i.e. an upper stop device 233 that limits of movement of holding device 220 upward relative to upper mass 212, and a lower stop device 234 that limits the movement of holding device 220 downward relative to upper mass 212. The stop devices can for example be provided by additional springs. It is advantageous to make the lower stop softer than the upper stop. Holding device 220 can be pressed into the lower stop if a too-strong pressure is exerted during guidance of soil compacting device 200. Holding device 220 can be pressed into the upper stop if soil compacting device 200 is lifted by holding device 220. This can for example also take place by means of a crane, so that the upper stop should be made stable. The stop devices are preferably provided in connection with metal springs as part of spring device 222.

In soil compacting device 200 of FIG. 3, point of rotation 223 is displaced as far as possible in the direction of the one longitudinal end of holding device 220, i.e. in the direction of a front end 240, while the center of gravity of holding device 220 is displaced as far as possible in the direction of the opposite longitudinal end, i.e. in the direction of a rear end 242. The displacement of the center of gravity toward the rear takes place via the attachment of component 232 in the actual grip area of holding device 220. In this way, the stress on a user due to hand-arm vibrations in the grip area at rear end 242 is reduced.

What is claimed is:

1. A soil compacting device comprising:

an upper mass having a drive;

a lower mass having a soil contact plate, the lower mass being coupled to the upper mass so as to be movable relative to the upper mass;

a holding device for holding the soil compacting device, the holding device being situated so as to be capable of movement relative to the upper mass;

a vibration decoupling device situated between the upper mass and the holding device, wherein the upper mass having the drive is separated from the holding device by the vibration decoupling device, the vibration decoupling device having;

a guide device that is configured to guide the movement of the holding device relative to the upper mass, the guide device being fashioned in such a way that the holding device is capable of being displaced in parallel relative to the upper mass; and a spring device acting on the upper mass and the holding device.

2. The soil compacting device as recited in claim 1, wherein the holding device is capable of being displaced in parallel to a longitudinal axis of the soil compacting device.

3. The soil compacting device as recited in claim 1, the guide device having a first guide body that is mounted so as to be capable of linear displacement in a correspondingly shaped opening of a second guide body.

4. The soil compacting device as recited in claim 1, wherein the guide device has a parallelogram guide.

5. The soil compacting device as recited in claim 4, wherein the parallelogram guide has a first guide element that is connected to the holding device and that is coupled to a second guide element by a linkage device, the second guide element being connected fixedly to the upper mass.

6. The soil compacting device as recited in claim 4, wherein the spring device is enclosed by the parallelogram guide.

7. The soil compacting device as recited in claim 1, further comprising:

an upper stop device that limits a movement of the holding device away from the upper mass, and a lower stop device that limits a movement of the holding device toward the upper mass.

8. The soil compacting device as recited in claim 1, wherein the drive comprises one of an internal combustion engine and an electric motor.

9. A soil compacting device, comprising:

an upper having a drive;

a lower mass having a soil contact plate, the lower mass being coupled to the upper mass to as to be movable relative to the upper mass;

a holding device for holding the soil compacting device, the holding device having a front end segment in the direction of a front longitudinal end thereof and a rear end segment in the direction of a rear longitudinal end thereof, the holding device being moveable relative to the upper mass;

a component that is situated on the holding device closer to the rear end segment than to a longitudinal axis of the soil compacting device; and a vibration decoupling device that is situated between the upper mass and the holding device, wherein the upper mass having the drive is separated from the holding device by the vibration decoupling device, the vibration decoupling device having a guide device that is configured to guide the movement of the holding device relative to the upper mass in such a way that the holding device is capable of rotation relative to the upper mass about an axis of rotation situated in a plane perpendicular to a longitudinal axis of the soil compacting device, the guide device being connected to the holding device at the front end segment of the holding device.

10. The soil compacting device as recited in claim 9, wherein the component is an electrical energy storage device.

11. The soil compacting device as recited in claim 9, wherein the vibration decoupling device has a spring device acting on the upper mass and the holding device.

12. The soil compacting device as recited in claim 11, wherein the spring device has an elastomer spring element and a metal spring.

13. The soil compacting device as recited in claim 9, further comprising:

an upper stop device that limits a movement of the holding device away from the upper mass, and having a lower stop device that limits a movement of the holding device toward the upper mass.

14. The soil compacting device as recited in claim 9, wherein the drive comprises one of an internal combustion engine ad an electric motor.

* * * * *